US006094117A

United States Patent [19]

Nuerenberg

[11] Patent Number: 6,094,117

[45] Date of Patent: Jul. 25, 2000

[54] ELECTROMAGNETIC SWITCHING DEVICE WITH RESTRICTED GUIDANCE

[75] Inventor: Klaus Dieter Nuerenberg, Koenigswinter, Germany

[73] Assignee: Kloeckner-Moeller GmbH., Bonn, Germany

[21] Appl. No.: 09/142,327

[22] PCT Filed: Feb. 27, 1997

[86] PCT No.: PCT/EP97/00956

§ 371 Date: Sep. 4, 1998

§ 102(e) Date: Sep. 4, 1998

[87] PCT Pub. No.: WO97/33289

PCT Pub. Date: Sep. 12, 1997

[30] Foreign Application Priority Data

Mar. 5, 1996 [DE] Germany ..... 296 04 046 U

[51] Int. Cl.[7] ..... H01H 7/16

[52] U.S. Cl. ..... 335/156; 335/127; 335/129; 335/131; 335/132; 335/189; 335/203

[58] Field of Search ..... 335/127–135, 335/189–191, 203, 255, 274, 156, 157, 158; 200/332, 335, 245, DIG. 42

[56] References Cited

U.S. PATENT DOCUMENTS

| | | | |
|---|---|---|---|
| 4,443,675 | 4/1984 | Drexler et al. | 200/243 |
| 4,625,194 | 11/1986 | Held | 335/271 |
| 4,737,749 | 4/1988 | Held | 335/131 |
| 4,988,964 | 1/1991 | Streich et al. | 335/131 |
| 5,075,660 | 12/1991 | Ootsuka | 335/131 |

FOREIGN PATENT DOCUMENTS

| | | |
|---|---|---|
| 0 174 467 | 3/1986 | European Pat. Off. . |
| 0 224 081 | 6/1987 | European Pat. Off. . |
| 0 358 050 | 12/1994 | European Pat. Off. . |
| 1 405 231 | of 1965 | France . |
| 2 517 113 | 5/1983 | France . |
| 1 437 396 | of 1996 | France . |
| 31 46 780 | 1/1983 | Germany . |
| 35 40 460 | 5/1987 | Germany . |
| 39 27 219 | 2/1991 | Germany . |

*Primary Examiner*—Michael L. Gellner
*Assistant Examiner*—Raymond Barrera
*Attorney, Agent, or Firm*—Kenyon & Kenyon

[57] ABSTRACT

An electromagnetic switching device (2) with restricted guidance, in which the closure contacts do not come into contact when the break contact is welded or fixed. An elastically resilient transmission lever (10) is provided to establish the effective connection between the armature (8) and the contact support (12) extending at a distance from and parallel to the armature.

9 Claims, 1 Drawing Sheet

ELECTROMAGNETIC SWITCHING DEVICE WITH RESTRICTED GUIDANCE

FIELD OF THE INVENTION

The present invention relates to an electromagnetic switchgear with restricted guidance in which the make contacts do not touch while the break contact is fixed.

RELATED TECHNOLOGY

This kind of electromagnetic switchgear, disclosed in German Patent Application No. 35 40 460 A1, contains a magnet system, which contains an armature; a movable contact carrier, which with fixed contacts hold movable contact parts forming break and make contacts and which assumes a rest position effected by spring force; and an additional elastic connection between the armature and the contact carrier in the form of a spring supported against the armature by a clip, by which it becomes possible with a welded break contact to move the armature without activating the make contacts (restricted guidance). An electromagnetic switchgear according to European Patent No. 358 050 B1 is further developed in such a way that, with a welded break contact, the magnet system yoke, which is elastically supported against the switchgear casing, can approach until the magnet system is closed. The disadvantage of the current state of technology is that additional elastic parts are needed to achieve the restricted guidance. It is not clear from the current state of technology how restricted guidance should be realized for electromagnetic switchgears in which the armature and contact carrier are arranged in parallel planes and whose movement directions thus run not behind one another but parallel or antiparallel, as is often the case with small contactors. (See for example German Patent No. 31 46 780 C2.

SUMMARY OF THE INVENTION

An object of the present invention is to achieve the restricted guidance without additional component parts and for the case of parallel arrangement of the armature and contact carrier.

The present invention provides that the movements of armature and contact carrier take place in parallel with a gap and provides an elastically flexible transmission lever which establishes the operative connection between the armature and contact carrier. In this way, without additional component parts, it is achieved that, when break contacts are fixed as a result of welding or mechanical barring, movement of the armature is permitted without activating a make contact.

In an advantageous further development, the support of the transmission lever against the switchgear casing favorably affects the transmission ratio of the forces to be transmitted. This is especially so when the transmission lever is coupled at one free end with the armature, is supported with the other free end against the casing part that holds the contact carrier, and is coupled with the contact carrier between both ends.

In another advantageous further development of the present invention, the use of a transmission lever with a maximum transmission force, particularly through spring elasticity, provides a secure closing of the magnet system, although the contact carrier cannot be moved as a result of a fixed break contact. Such spring-like flexible transmission elements are known per se as snap elements in other contexts, for example according to German Patent Application No. 39 27 219 A1.

BRIEF DESCRIPTION OF THE DRAWINGS

The present invention will be explained in greater detail below using an exemplary embodiment from which further details and advantages can be seen. In the corresponding drawing.

DETAILED DESCRIPTION

Figure 1:
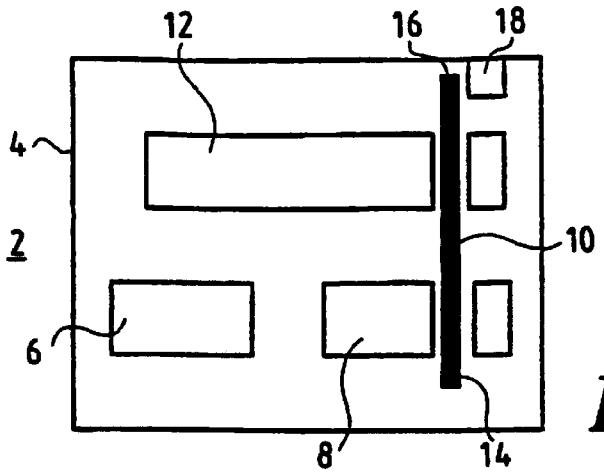
FIG. 1 shows an electromagnetic switchgear according to the present invention schematically depicted in the off position.
Figure 2:
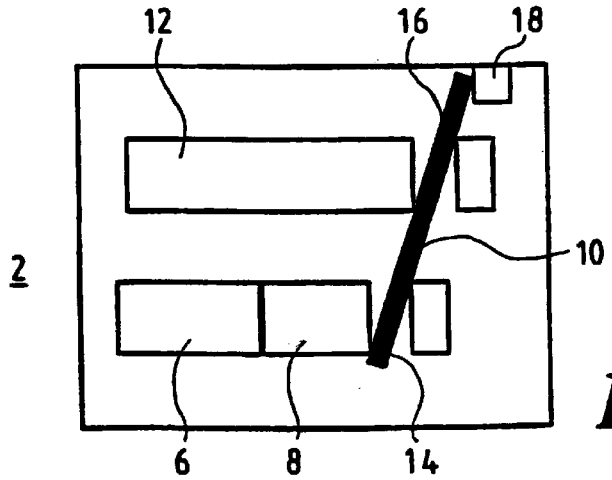
FIG. 2 shows the same in the on position

In FIG. 1 and FIG. 2, electromagnetic switchgear 2 is surrounded by a switchgear casing 4. Within switchgear casing 4 a magnet system is arranged as a contact drive, which includes a fixed magnet part 6 and a movable armature 8. The linear movement of armature 8 toward fixed magnet part 6, caused when the magnet system is activated, is transmitted by a transmission lever 10 to a contact bridge 12 which is movable in parallel to armature 8. Movable contact parts, which are not depicted, are held on contact carrier 12, and they form break or make contacts with fixed contacts attached to switchgear casing 4. In the off position as shown in FIG. 1, the break contacts are closed and the make contacts open, while restoring spring forces, which are not depicted in detail, impact on armature 8 and/or contact carrier 12. In the on position as shown in FIG. 2, the break contacts are open and the make contacts are closed. The transmission lever 10 is coupled at its free end 14 with armature 8. It is supported at its other free end 16 against a support position 18 located on that casing part of switchgear casing 4 in which the contact carrier 12 is placed. Between its two ends 14 and 16, the transmission lever is coupled with contact carrier 12, so that when the magnet system is deactivated or activated the movement of armature 8 occurs, with a favorable force transmission ratio into the corresponding parallel movement of the contact carrier into the off position (FIG. 1) or into the on position (FIG. 2).

Figure 3:
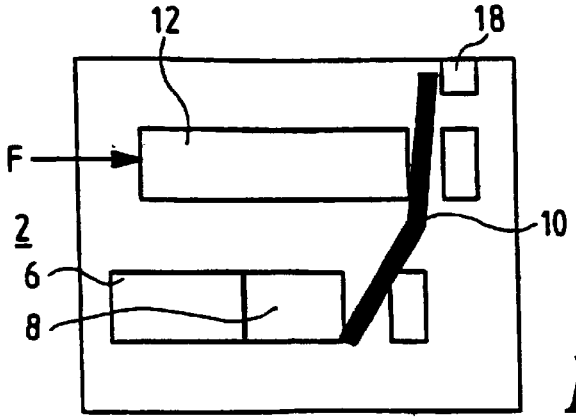
FIG. 3 shows the same in the blocked on position.

FIG. 3 depicts the case when at least one break contact is welded or contact carrier 12 is blocked by a mechanical barring device not depicted. In this way, when the magnet system is activated, a counterforce F is applied to contact carrier 12. Normally, armature 8 could no longer move toward fixed magnet part 6. This would result in an overloading of the magnet system, in particular to burn-out of its exciting winding, which is not depicted, or to a bending of break contacts and, as a result, to the closing of the make contacts. It is advantageous for transmission lever 10 to be designed as an elastically flexible lever (snap lever), which yields in a spring-like manner when a critical stress is exceeded. In this way, on the one hand, the magnet system is closed by magnetic contacting of armature 8 with fixed magnet part 6, and on the other hand counterforce F on contact carrier 12 is limited. This effectively prevents both the overloading of the magnet circuit and the closing of the make contact, that is, the restricted guidance of the electromagnetic switchgear is guaranteed in all cases. The term parallel movement as used herein includes parallel or antiparallel movement.

What is claimed is:

1. An electromagnetic switchgear with restricted guidance comprising;

a magnetic system having an armature movable along an armature movement path;

a movable contact carrier holding movable contact parts forming a break contact and a make contact with fixed contacts, the movable contact carrier having a rest position effected by a spring force and being movable parallel to the armature movement path, the movable contact carrier being spaced by a gap from the armature movement path; and an elastically flexible transmission lever operatively connecting the armature and the contact carrier, the armature and the contact carrier being elastically connected so that the armature moves without activating the make contact when the break contact is welded or blocked.

2. The electromagnetic switchgear as recited in claim 1 wherein when the break contact is welded or blocked the break contact is capable of providing a counterforce on the contact carrier, the counterforce being limited as a function of a maximum transmission force of the flexible transmission lever on the contact carrier.

3. The electromagnetic switchgear as recited in claim 2 wherein the transmission lever has a spring characteristic so that the transmission lever yields when the counterforce exceeds a certain level.

4. The electromagnetic switchgear as recited in claim 1 wherein the transmission lever is supported against a switchgear casing.

5. The electromagnetic switchgear as recited in claim 4 wherein when the break contact is welded or blocked the break contact is capable of providing a counterforce on the contact carrier, the counterforce being limited as a function of a maximum transmission force of the flexible transmission lever on the contact carrier.

6. The electromagnetic switchgear as recited in claim 5 wherein the transmission lever has a spring characteristic so that the transmission lever yields when the counterforce exceeds a certain level.

7. An electromagnetic switchgear with restricted guidance comprising:

a magnetic system having an armature movable along an armature movement path;

a movable contact carrier for holding movable contact parts forming a break contact and a make contact with fixed contacts, the movable contact carrier having a rest position effected by a spring force and being movable parallel to the armature movement path, the movable contact carrier being spaced by a gap from the armature movement path; and an elastically flexible transmission lever operatively connecting the armature and the contact carrier, the armature and the contact carrier being elastically connected so that the armature is capable of moving without activating the make contact when the break contact is welded or blocked; the transmission lever being coupled at one free end with the armature, supported at an other free end against a part of the switchgear casing holding the contact carrier, and coupled with the contact carrier between the one free end and the other free end.

8. An electromagnetic switchgear with restricted guidance comprising:

a magnetic system having an armature movable along an armature movement path;

a movable contact carrier for holding movable contact parts forming a break contact and a make contact with fixed contacts, the movable contact carrier having a rest position effected by a spring force and being movable parallel to the armature movement path, the movable contact carrier being spaced by a gap from the armature movement path; and an elastically flexible transmission lever operatively connecting the armature and the contact carrier, the armature and the contact carrier being elastically connected so that the armature is capable of moving without activating the make contact when the break contact is welded or blocked; wherein when the break contact is welded or blocked the break contact is capable of providing a counterforce on the contact carrier, the counterforce being limited as a function of a maximum transmission force of the flexible transmission lever on the contact carrier; the transmission lever being coupled at one free end with the armature, supported at an other free end against a part of the switchgear casing holding the contact carrier, and coupled with the contact carrier between the one free end and the other free end.

9. The electromagnetic switchgear as recited in claim 8 wherein the transmission lever has a spring characteristic so that the transmission lever yields when the counterforce exceeds a certain level.

* * * * *